US006991880B2

(12) United States Patent
Tong et al.

(10) Patent No.: US 6,991,880 B2
(45) Date of Patent: Jan. 31, 2006

(54) IMAGING MEMBERS

(75) Inventors: Yuhua Tong, Webster, NY (US); Timothy J. Fuller, Pittsford, NY (US); Sean X. Pan, Penfield, NY (US); John F. Yanus, Webster, NY (US); Cindy C. Chen, Rochester, NY (US); Min-Hong Fu, Webster, NY (US); Dennis J. Prosser, Walworth, NY (US); Susan M. VanDusen, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 61 days.

(21) Appl. No.: 10/201,869

(22) Filed: Jul. 23, 2002

(65) Prior Publication Data

US 2004/0018439 A1 Jan. 29, 2004

(51) Int. Cl.
*G03G 5/047* (2006.01)

(52) U.S. Cl. ..... 430/58.15; 430/58.2; 430/58.25; 430/58.5; 430/58.65; 430/58.75; 430/58.8; 430/59.6; 430/120

(58) Field of Classification Search ..... 430/58.15, 430/58.2, 58.3, 58.5, 58.8, 59.6, 96, 66, 58.25, 430/58.65, 58.75, 120
See application file for complete search history.

(56) References Cited

U.S. PATENT DOCUMENTS

| | | | | |
|---|---|---|---|---|
| 4,265,990 | A | 5/1981 | Stolka et al. | |
| 4,410,616 | A | 10/1983 | Griffiths et al. | |
| 4,806,443 | A | 2/1989 | Yanus et al. | |
| 4,988,595 | A * | 1/1991 | Pai et al. | 430/73 |
| 5,468,583 | A * | 11/1995 | Gruenbaum et al. | 430/58.5 |
| 5,882,829 | A * | 3/1999 | Hsieh et al. | 430/58.3 |
| 5,905,008 | A * | 5/1999 | Yoshinaga et al. | 430/58.2 |
| 6,198,889 | B1 * | 3/2001 | Yu et al. | 399/75 |

OTHER PUBLICATIONS

ACS File Registry Number RN-25135-52-8 Copyright 2003.*
Diamond, A.S., ed., Handbook of Imaging Materials, Marcel Dekker, Inc., NY (1991), pp. 395-396.*

* cited by examiner

*Primary Examiner*—Janis L. Dote

(74) *Attorney, Agent, or Firm*—Oliff & Berridge, PLC

(57) ABSTRACT

A member including for example, a substrate, a charge generating layer, a charge transport layer comprising a poly(phenylsilsesquioxane), molecule, and a film forming binder.

15 Claims, 1 Drawing Sheet

IMAGING MEMBERS

CROSS REFERENCE TO COPENDING APPLICATION

U.S. patent application Ser. No. 09/302,524, filed in the names of D. Murti, et al. on Apr. 30, 1999, now abandoned, discloses a photoconductive imaging member which is comprised of a supporting substrate, and thereover a layer comprised of a photogenerator hydroxygallium component, a charge transport component, and an electron transport component. U.S. patent application Ser. No. 09/627,283, filed in the names of Lin, et al. on Jul. 28, 2000, now abandoned, discloses an imaging member having a single electrophotographic layer. The entire disclosure of this patent application is incorporated herein by reference.

BACKGROUND

The present invention is generally directed to layered imaging members, imaging apparatus, and processes thereof More specifically, the present invention relates in general to electrophotographic imaging members and more specifically, to electrophotographic imaging members having a charge transport layer that has been reinforced with a ladder-like poly(phenylsilsesquioxane) (PPSQ) represented by:

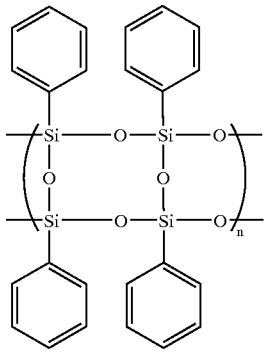

in which n represents the number of repeating segments, and to processes for forming images on the member.

A photoreceptor with a reinforced charge transport layer refers, for example, to a device wherein the charge transport layer includes a ladder-like polysilsesquioxane, which is a strong hybrid material with a high glass transition temperature and excellent stability. Poly(phenylsilsesquioxane) can be introduced into the charge transport layer without modifying the charge layer preparation and manufacturing procedures. In embodiments, a small percentage of poly(phenylsilsesquioxane) components are doped in the charge transport layer to sensitize the chlorogallium phthalocyanine pigment in the charge-generating layer.

Numerous imaging members for electrostatographic imaging systems are known including selenium, selenium alloys, such as, arsenic selenium alloys, layered inorganic imaging and layered organic members. Examples of layered organic imaging members include those containing a charge transporting layer and a charge generating layer. Thus, for example, an illustrative layered organic imaging member can be comprised of a conductive substrate, overcoated with a charge generator layer, which in turn is overcoated with a charge transport layer, and an optional overcoat layer overcoated on the charge transport layer. In a further "inverted" variation of this device, the charge transport layer can be overcoated with the photogenerator layer, or charge generator layer. Examples of generator layers that can be employed in these members include, for example, charge generator components, such as, selenium, cadmium sulfide, vanadyl phthalocyanine, x-metal free phthalocyanine, benzimidazole perylene (BZP), hydroxygallium phthalocyanine (HOGaPc), chlorogallium phthalocyanine, and trigonal selenium dispersed in binder resin, while examples of transport layers include dispersions of various diamines, reference for example, U.S. Pat. No. 4,265,990, the disclosure of which is incorporated herein by reference in its entirety.

One problem encountered with photoreceptors comprising a charge generating layer and the charge transport layer is that the thickness of the charge transport layer, which is normally the outermost layer, tends to become thinner during image cycling. This change in thickness causes changes in the electrical properties of the photoreceptor. Thus, in order to maintain image quality, complex and sophisticated electronic equipment is necessary in the imaging machine to compensate for the electrical changes. This increases the complexity of the machine, cost of the machine, size of the footprint occupied by the machine, and the like. Without proper compensation of the changing electrical properties of the photoreceptor during cycling, the quality of the images formed degrades due to spreading of the charge pattern on the surface of the imaging member and a decline in image resolution. High quality images are essential for digital copiers, duplicators, printers, and facsimile machines, particularly laser exposure machines that demand high resolution images.

There continues to be a need for improved imaging members, and improved imaging systems utilizing such members. Additionally, there continues to be a need for imaging members of varying sensitivity, which members are economical to prepare and retain their properties over extended periods of time.

A number of current electrophotographic imaging members comprise charge transport components and polymer binders, such as N,N'-diphenyl-N,N'-di(m-tolyl)-p-benzidine (m-TPD) and a binder polycarbonate. Devices with this composition are susceptible to physical damage such as phase deformation, cracking and low wear resistance.

One feature of this invention is to improve the strength of electrophotographic imaging members photoreceptors by incorporating stronger inert components into the transport layer to, for example, allow for more stable photoinduced discharge characteristics curves.

REFERENCES

In U.S. Pat. No. 4,410,616, to Griffiths et al., issued Oct. 18, 1983, there is disclosed an improved ambi-polar photoresponsive device useful in imaging systems for the production of positive images, from either positive or negative originals, which device is comprised of: (a) supporting substrate, (b) a first photogenerating layer, (c) a charge transport layer, and (d) a second photogenerating layer, wherein the charge transport layer is comprised of a highly insulating organic resin having dissolved therein components of an electrically active material of N,N'-diphenyl-N,N'-bis("X substituted" phenyl)-(1,1,-biphenyl)-4,4'-diamine wherein X is selected from the group consisting of alkyl and halogen.

U.S. Pat. No. 4,265,990 to Stolka, et al., issued May 5, 1981, illustrates a photosensitive member having at least two electrically operative layers. The first layer comprises a photoconductive layer which is capable of photogenerating holes and injecting photogenerated holes into a contiguous charge transport layer. The charge transport layer comprises a polycarbonate resin containing from about 25 to about 75 percent by weight of one or more compounds having a specified general formula. This structure may be imaged in the conventional imaging mode which usually includes charging, exposure to light and development.

U.S. Pat. No. 4,806,443, to Yanus et al., issued Feb. 21, 1989, describes a charge transport layer including a polyether carbonate (PEC) obtained from the condensation of N,N'-diphenyl-N,N'bis(3-hydroxy phenyl)-(1,1'-biphenyl)-4,4'-diamine and diethylene glycol bischloroformate. U.S. Pat. No. 4,025,341 similarly describes that a photoreceptor includes a charge transport layer including any suitable hole transporting material such as poly(oxycarbonyloxy-2-methyl-1,4-phenylenecyclohexylidene-3-methyl-1,4-phenylene. What is still desired is an improved material for a charge transport layer of an imaging member that exhibits excellent performance properties the same as or better than existing materials discussed above.

The entire disclosures of these patents are incorporated herein by reference.

BRIEF SUMMARY

Figure 1:
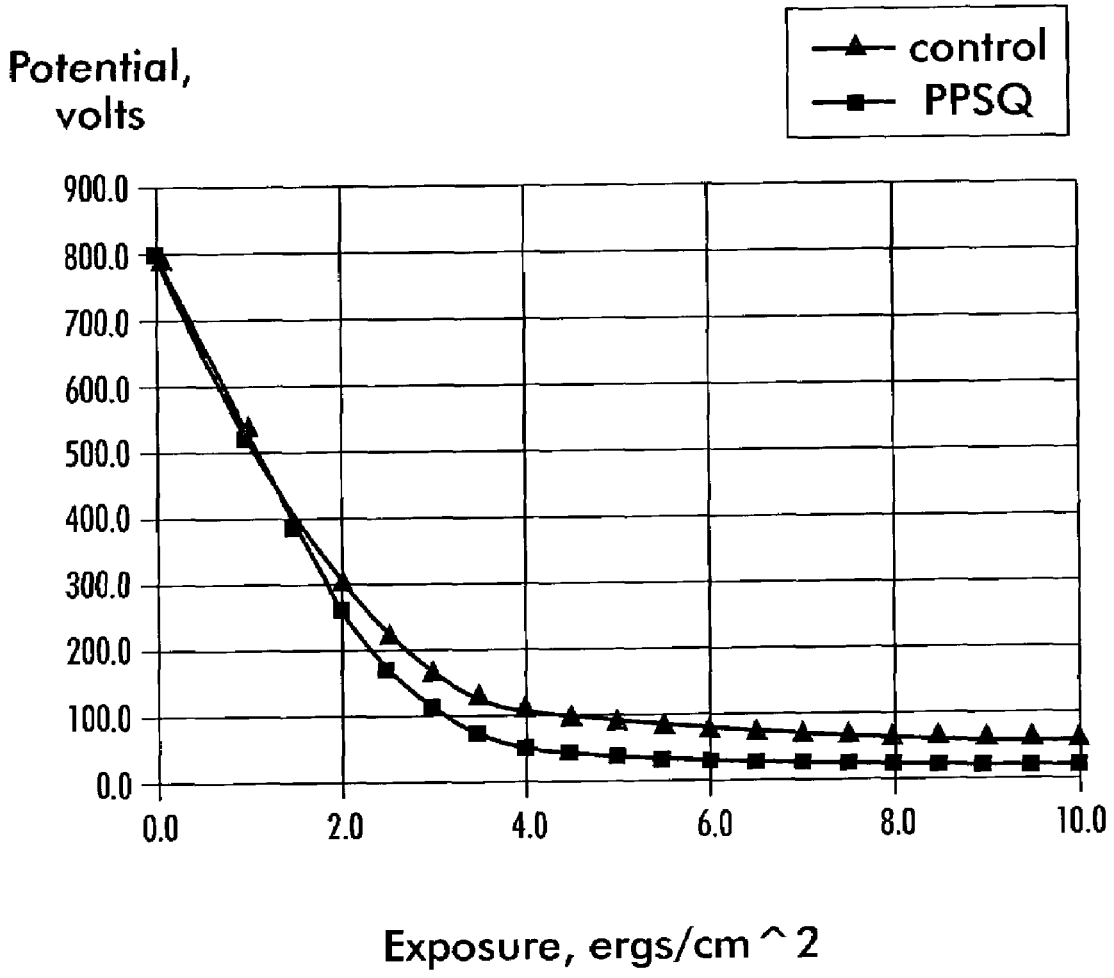
FIG. 1 illustrates the photo-induced discharge curve for a device with poly(phenylsilsesquioxane) in the charge transport layer and for a device without poly(phenylsilsesquioxane) in the charge transport layer.

Disclosed herein is an improved electrophotographic imaging member comprising a flexible supporting substrate having an electrically conductive layer, a charge blocking layer, an optional adhesive layer, a charge-generating layer, a charge transporting layer comprising poly(phenylsilsesquioxane) molecule, and a film forming binder.

Further disclosed is an improved electrophotographic imaging member comprising a charge transport layer comprising poly(phenylsilsesquioxane) dispersed in an inactive resin binder.

Also disclosed is an improved electrophotographic imaging member comprising an electron transport molecule in the charge transport layer which functions to sensitize the chlorogallium phthalocyanine pigment in the charge generating layer.

Further disclosed herein is an improved electrophotographic imaging member for which photoinduced discharge characteristics (PIDC) curves do not change with time or repeated use.

By the use of the disclosed poly(phenylsilsesquioxane) materials in the charge transport layer of the present invention, a charge transport layer of an imaging member is achieved that has excellent hole transporting performance and wear resistance, and that is able to be coated onto the imaging member structure using known conventional methods.

Aspects illustrated herein relate to;

a substrate, a charge blocking layer, an optional adhesive layer, a charge generating layer, a charge transport layer comprising; and a poly(phenylsilsesquioxane) molecule represented by:

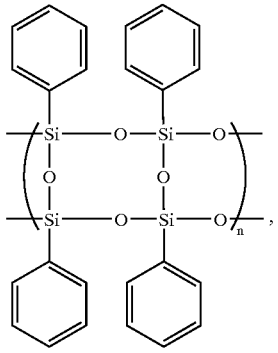

in which n represents the number of repeating segments, a charge transport molecule selected, for example, from the group consisting of an arylamine, a hydrozone and an electron transporter selected for example, from the group consisting of N,N'bis(1,2-dimethylpropyl)-1,4,5,8-naphthalenetetracarboxylic diimide represented by:

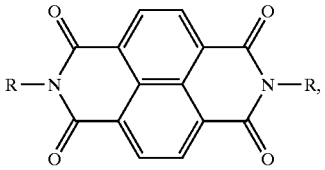

wherein each R is a 1,2-dimethylpropyl group, 1,1'-dioxo-2-(4-methylphenyl)-6-(4-methylphenyl)-4-(dicyanomethylidene)thiopyran represented by:

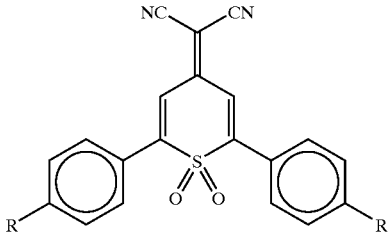

wherein each R is a methyl group, and a quinone selected from the group consisting of: carboxybenzylnaphthaquinone represented by:

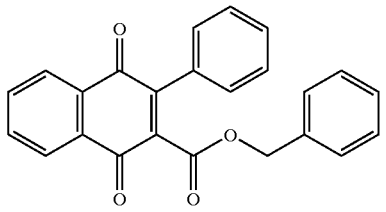

, and tetra (t-butyl) diphenoquinone represented by:

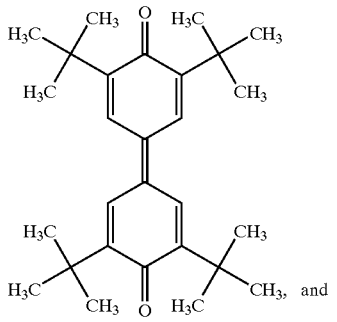

, and mixtures thereof, and a film forming binder.

The imaging member may be imaged by depositing a uniform electrostatic charge on the imaging member, exposing the imaging member to activating radiation in image configuration to form an electrostatic latent image, and developing the latent image with electrostatically attractable marking particles to form a toner image in conformance to the latent image.

The binder of the charge transport member may be selected from the group consisting of polyesters, polyvinyl butyrals, polycarbonates, polystyrene-b-polyvinyl pyridine, poly(vinyl butyrals), poly(vinyl carbazole), poly(vinyl chloride), polyacrylates, polymethacrylates, copolymers of vinyl chloride and vinyl acetate, phenoxy resins, polyurethanes, poly(vinyl alcohol), polyacrylonitrile, and polystyrene.

Any suitable substrate may be employed in the imaging member of this invention. The substrate may be opaque or substantially transparent, and may comprise any suitable material having the requisite mechanical properties. Thus, for example, the substrate may comprise a layer of insulating material including inorganic or organic polymeric materials, such as, MYLAR® a commercially available polymer, MYLAR® coated titanium, a layer of an organic or inorganic material having a semiconductive surface layer, such as, indium, tin, oxide, aluminum, titanium and the like, or exclusively be made up of a conductive material, such as, aluminum, chromium, nickel, brass and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer.

The thickness of the substrate layer depends on numerous factors, including mechanical performance and economic considerations. The thickness of this layer may range from about 65 micrometers to about 3,000 micrometers, and in embodiments from about 75 micrometers to about 1,000 micrometers for optimum flexibility and minimum induced surface bending stress when cycled around small diameter rollers, for example, 19 millimeter diameter rollers. The surface of the substrate layer is preferably cleaned prior to coating to promote greater adhesion of the deposited coating composition. Cleaning may be effected by, for example, exposing the surface of the substrate layer to plasma discharge, ion bombardment, and the like methods.

Electron blocking layers for positively charged photoreceptors allow holes from the imaging surface of the photoreceptor to migrate toward the conductive layer. For negatively charged photoreceptors, any suitable charge blocking layer capable of forming a barrier to prevent hole injection from the conductive layer to the opposite photoconductive layer may be utilized. The charge blocking layer may include polymers such as polyvinylbutyral, epoxy resins, polyesters, polysiloxanes, polyamides, polyurethanes, and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium-4-aminobenzoate isostearate oxyacetate, $(H_2N(CH_2)_4)CH_3Si(OCH_3)_2$, (gamma-aminobutyl) methyl diethoxysilane, and $(H_2N(CH_2)_3)CH_3Si(OCH_3)_2$, (gamma-aminopropyl)-methyl diethoxysilane, as disclosed in U.S. Pat. Nos. 4,338,387, 4,286,033 and 4,291,110. Other suitable charge blocking layer polymer compositions are also described in U.S. Pat. No. 5,244,762. These include vinyl hydroxyl ester and vinyl hydroxy amide polymers, wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still, other suitable charge blocking layer polymer compositions are described in U.S. Pat. No. 4,988,597. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of the U.S. Patents are incorporated herein by reference in their entirety.

The blocking layer is continuous and may have a thickness of less than about 10 micrometers because greater thicknesses may lead to undesirably high residual voltage. In embodiments, a blocking layer of from about 0.005 micrometers to about 1.5 micrometers facilitates charge neutralization after the exposure step and optimum electrical performance is achieved. The blocking layer may be applied by any suitable conventional technique such as spraying, dip coating, draw bar coating, gravure coating, silk screening, air knife coating, reverse roll coating, vacuum deposition, chemical treatment, and the like. For convenience in obtaining thin layers, the blocking layer is in embodiments applied in the form of a dilute solution, with the solvent being removed after deposition of the coating by conventional techniques, such as, by vacuum, heating, and the like. Generally, a weight ratio of blocking layer material and solvent of from about 0.05:100 to about 5:100 is satisfactory for spray coating.

If desired an optional adhesive layer may be formed on the substrate. Typical materials employed in an undercoat layer include, for example, polyesters, polyamides, poly (vinyl butyral), poly(vinyl alcohol), polyurethane and polyacrylonitrile, and the like. Typical polyesters include, for example, VITEL® PE100 and PE200 available from Goodyear Chemicals, and MOR-ESTER 49,000® available from Norton International. The undercoat layer may have any suitable thickness, for example, of from about 0.001 micrometers to about 30 micrometers. A thickness of from about 0.1 micrometers to about 3 micrometers is used in a specific embodiment. Optionally, the undercoat layer may contain suitable amounts of additives, for example, of from about 1 weight percent to about 10 weight percent, of conductive or nonconductive particles, such as, zinc oxide, titanium dioxide, silicon nitride, carbon black, and the like, to enhance, for example, electrical and optical properties. The undercoat layer can be coated onto a supporting substrate from a suitable solvent. Typical solvents include, for example, tetrahydrofuran, dichloromethane, xylene, ethanol, methyl ethyl ketone, and mixtures thereof.

The components of the photogenerating layer comprise photogenerating particles, for example, of Type V hydroxygallium phthalocyanine, x-polymorph metal free phthalocyanine, or chlorogallium phthalocyanine photogenerating pigments dispersed in a matrix comprising arylamine hole transport molecules and certain selected electron transport molecules. Type V hydroxygallium phthalocyanine is well known and has X-ray powder diffraction (XRPD) peaks at, for example, Bragg angles (2 theta +/−0.2°) of 7.4, 9.8, 12.4, 16.2, 17.6, 18.4, 21.9, 23.9, 25.0, 28.1, with the highest peak at 7.4 degrees. The X-ray powder diffraction traces (XRPDs) were generated on a Philips X-Ray Powder Diffractometer Model 1710 using X-radiation of CuK-alpha wavelength (0.1542 nanometer). The diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter. Type V hydroxygallium phthalocyanine may be prepared by hydrolyzing a gallium phthalocyanine precursor including dissolving the hydroxygallium phthalocyanine in a strong acid and then reprecipitating the resulting dissolved precursor in a basic aqueous media; removing any ionic species formed by washing with water; concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles in embodiments have an average particle size of less than about 5 micrometers.

The photogenerating layer containing photoconductive compositions and/or pigments and the resinous binder material generally ranges in thickness of from about 0.1 micrometers to about 5.0 micrometers, and in embodiments have a thickness of from about 0.3 micrometers to about 3 micrometers. The photogenerating layer thickness is generally related to binder content. Thus, for example, higher binder content of 30 compositions generally require thicker layers for photogeneration. Of course, thickness outside these ranges can be selected providing the objectives of the present invention are achieved.

The active charge transport layer may comprise any suitable transparent organic polymer or non-polymeric material capable of supporting the injection of photo-generated holes and electrons from the charge generating layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, for example, 4,000 Angstroms to 8,000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generating layer. The active transport layer is normally transparent when exposure is effected through the active layer to ensure that most of the incident radiation is utilized by the underlying charge generating layer for efficient photogeneration. The charge transport layer in conjunction with the generating layer is a material which is an insulator to the extent that an electrostatic charge placed on the transport layer is not conductive in the absence of illumination, that is, does not discharge at a rate sufficient to prevent the formation and retention of an electrostatic latent image thereon.

In embodiments, a transport layer employed in the electrically operative layer in the photoconductor embodiment of this invention comprises from about 25 to about 75 percent by weight of at least one charge transporting aromatic amine compound, from about 0.1 to about 10 weight percent of poly(phenylsilsesquioxane), and about 75 to about 25 percent by weight of a polymeric film forming resin in which the aromatic amine is soluble. The charge transport layer may comprise the film forming binder in an amount of from about 20 to about 80 percent by weight. Examples of charge transporting aromatic amines for charge transport layer(s) capable of supporting the injection of photogenerated holes of a charge generating layer and transporting the holes through the charge transport layer include N,N'-diphenyl-N,N'-di(m-tolyl)-p-benzidine, (m-TPD).

The charge transport layer of the imaging member may be comprised of an aryl amine:

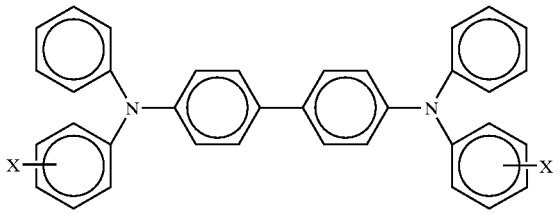

In which X is selected from the group consisting of alkyl and halogen. In embodiments, the aryl amine is N,N'-diphenyl-N,N'-bis(3-methylphenyl)-(1,1'-biphenyl)-4,4'-diamine. In embodiments, the charge transport layer comprises a compound selected from the group consisting of N,N'-diphenyl-N,N'-bis(3-methylphenyl)-(1,1'-biphenyl)-4,4'diamine; N,N'-diphenyl-N,N'-bis(alkylphenyl)-1,1-biphenyl-4,4'-diamine; tritolylamine; N,N'-bis-(3,4-dimethylphenyl)-4-biphenyl amine; N,N'-bis-(4-methylphenyl)-N,N"-bis(4-ethylphenyl)-1,1'-3,3'-dimethylbiphenyl)-4,4'-diamine; phenanthrene diamine; and stilbene molecules.

The charge transport layer may comprise an electron transport component from the group consisting of 1,1'-dioxo-2-(4-methylphenyl)-6-(4-methylphenyl)-4-(dicyanomethylidene)thiopyran, butoxy carbonyl fluorenylidene malononitrile, carboxybenzylnaphthaquinone, tetra (t-butyl) diphenoquinone, perinone, thiopyran, N,N'-bis(1,2-dimethylpropyl)-1,4,5,8-naphthalenetetracarboxylic diimide, 1,1'-dioxo-2-(4-methylphenyl)-6-phenyl(4-methylphenyl)-4-(dicyanomethylidene)thiopyran represented by:

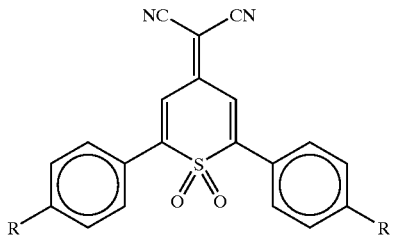

wherein each R is methyl and a quinone selected from the group consisting of: carboxybenzylnaphthaquinone represented by:

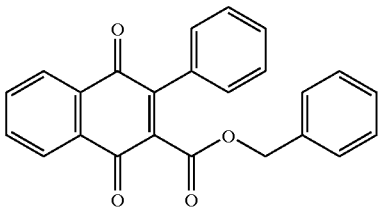

, and tetra (t-butyl) diphenoquinone represented by:

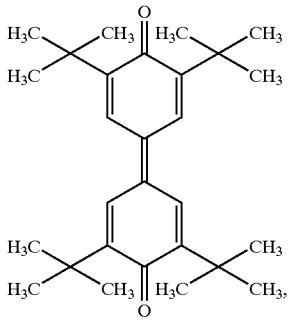

, and mixtures thereof. In embodiments, the electron transport component is N,N'bis(1,2-dimethylpropyl)-1,4,5,8-naphthalenetetracarboxylic diimide.

Any polymer which forms a solid solution with the hole transport molecule is a suitable polymer material for use in forming a hole transport layer in a photoreceptor device. Any suitable inactive resin binder soluble in methylene chloride or other suitable solvent may be employed. Any suitable and conventional technique may be utilized to apply the charge transport layer and the charge generating layer. Typical application techniques include; spraying, dip coating, roll coating, wire wound rod coating, and the like. Drying of the deposited coating may be effected by any suitable conventional technique such as oven drying, infrared radiation drying, air drying and the like. Generally, the thickness of the transport layer is from about 5 micrometers to about 100 micrometers, but thicknesses outside this range can also be used. In general, the ratio of the thickness of the charge transport layer to the charge generating layer is in embodiments maintained from about 2:1 to 200:1 and in some instances as great as 400:1. The charge transport layer material may also include additional additives used for their known conventional functions as recognized by practitioners in the art. Such as, for example, antioxidants, leveling agents, surfactants, wear resistant additives, such as, polytetrafluoroethylene (PTFE) particles, light shock resisting or reducing agents, and the like.

The solvent system can be included as a further component of the charge transport layer material. Conventional binder resins for charge transport layers have utilized the use of methylene chloride as a solvent to form a coating solution, for example, that renders the coating suitable for application via dip coating. However, methylene chloride has environmental concerns that usually require this solvent to have special handling and results in the need for more expensive coating and clean-up procedures. Currently, however, binder resins can be dissolved in a solvent system that is more environmentally friendly than methylene chloride, thereby enabling the charge transport layer to be formed less expensively than with some conventional polycarbonate binder resins. In embodiments, a solvent system for use with the charge transport layer material of the present invention comprises tetrahydrofuran, toluene, and the like.

The total solid to total solvents of the coating material may, for example, be around about 10:90 weight percent to about 30:70 weight percent, and in embodiments from about 15:85 weight percent to about 25:75 weight percent.

The components may be added together in any suitable order, although the solvent system is in embodiments added to the vessel first. The transport molecule binder polymer may be dissolved together, although each is in embodiments dissolved separately and then combined with the solution in the vessel. Once all of the components of the charge transport layer material have been added to the vessel, the solution may be mixed to form a uniform coating composition.

The charge transport layer solution is applied to the photoreceptor structure. More in particular, the charge transport layer is formed upon a previously formed layer of the photoreceptor structure. In embodiments, the charge transport layer may be formed upon a charge generating layer. Any suitable and conventional techniques may be utilized to apply the charge transport layer coating solution to the photoreceptor structure. Typical application techniques include, for example, spraying, dip coating, extrusion coating, roll coating, wire wound rod coating, draw bar coating, and the like.

The dried charge transport layer in embodiments has a thickness of, for example, from about 10 micrometers to about 50 micrometers. In general, the ratio of the thickness of the charge transport layer to the charge generating layer is in embodiments maintained from about 2:1 to about 200:1, and in some instances as great as about 400:1. The charge transport layer of the invention possesses excellent wear resistance.

Any suitable multilayer photoreceptor may be employed in the imaging member of this invention. The charge generating layer and charge transport layer as well as the other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference. In embodiments, however, the charge transport layer is employed upon a charge generating layer, and the charge transport layer may optionally be overcoated with an overcoat and/or protective layer.

Any suitable arylamine hole transporter molecules may be utilized in the single photogenerating layer. In embodiments an arylamine charge hole transporter molecule may be represented by:

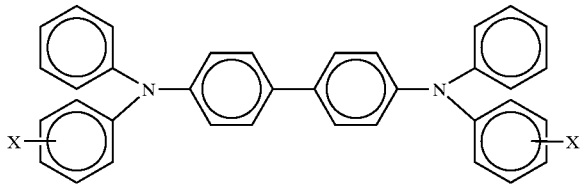

wherein X is selected from the group consisting of alkyl and halogen. Typically, the halogen is a chloride. The alkyl typically contains from about 1 to about 10 carbon atoms, and in embodiments from about 1 to about 5 carbon atoms. Typical aryl amines include, for example, N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine, wherein the halo substituent is preferably a chloro substituent. Other specific examples of aryl amines include, 9-9-bis(2-cyanoethyl)-2,7-bis(phenyl-m-tolylamino)fluorene, tritolylamine, N,N'-bis(3,4dimethylphenyl)-N"(1-biphenyl) amine, 2-bis ((4'-methylphenyl) amino-p-phenyl) 1,1-diphenyl ethylene, 1-bisphenyl-diphenylamino-1-propene, and the like.

The electron transporter in the single photoconductive insulating layer of the photoreceptor can be selected from the group consisting of known compounds such as N,N' bis(1,2-dimethylpropyl)-1,4,5,8-naphthalenetetracarboxylic diimide (NTDI) represented by:

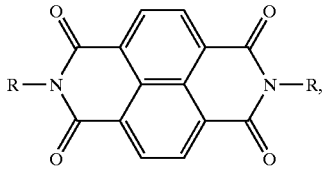

wherein each R is a 1,2-dimethylpropyl group; 1,1'-dioxo-2-(4-methylphenyl)-6-phenyl-4-dicyanomethylidene)thiopyran; butoxy carbonyl fluorenylidene malononitrile; carboxybenzylnaphthaquinone; tetra (t-butyl) diphenoquinone, perinone, thiopyran, N,N'-diphenyl-N,N'-bis(alkylphenyl)-1,1-biphenyl-4,4'-diamine; 1,1'-dioxo-2-(4-methylphenyl)-6-(4-methylphenyl)-4-(dicyanomethylidene)thiopyran represented by:

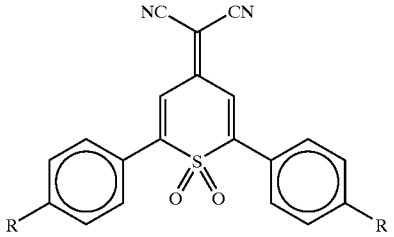

wherein each R is a methyl group, and a quinone selected from the group consisting of:

carboxybenzylnaphthaquinone represented by:

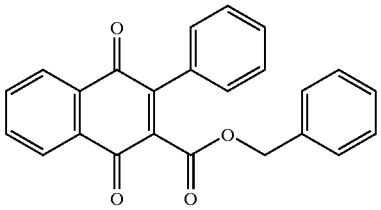

and tetra (t-butyl) diphenoquinone represented by:

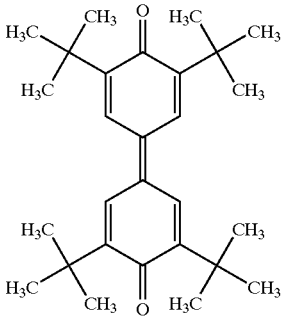

and a film forming binder.

These electron transporting materials contribute to the ambipolar properties of the final photoreceptor and also provide the desired rheology and freedom from agglomeration during the preparation and application of the coating dispersion. Moreover, these electron transporting materials ensure substantial discharge of the photoreceptor during image wise exposure to form the electrostatic latent image.

Any suitable film forming binder may be utilized in the photoconductive insulating layer of this invention. Typical film forming binders include, for example, polyesters, polyvinyl butyrals, polycarbonates, polystyrene-b-polyvinyl pyridine, poly(vinyl butyral), poly(vinyl carbazole), poly (vinyl chloride), polyacrylates, polymethacrylates, copolymers of vinyl chloride and vinyl acetate, phenoxy resins, polyurethanes, poly(vinyl alcohol), polyacrylonitrile, polystyrene, and the like. Specific electrically inactive binders include polycarbonate resins with a weight average molecular weight of from about 20,000 to about 100,000. In embodiments, a weight average molecular weight of from about 50,000 to about 100,000 is specifically selected. More specifically, good results are achieved with poly(4,4'-diphenyl-1,1'-cyclohexane carbonate) PCZ, Bisphenol-Z polycarbonate; poly(4,4'-diphenyl-1,1'-cyclohexane carbonate-500), with a weight average molecular weight of 51,000; or poly(4,4'-diphenyl-1,1'-cyclohexane carbonate-400), with a weight average molecular weight of 40,000.

The Polytetrafluoroethylene (polytetrafluroethylene) of from about 0.1 microns to about 20 microns, and in embodiments from about 0.1 microns to about 5 microns, and is commercially available from Du Pont Company and Daikin International. A surfactant in an amount of from about 0.5 to about 5 parts surfactant per about 100 parts polytetrafluoroethylene can be utilized to disperse polytetrafluroethylene particles in organic solvents, such as, tetrahydrofuran. An example of a useful surfactant is GF-300, available from Toagosei America, Inc.

The photogenerating pigment can be present in various amounts, such as, for example, from about 0.05 weight percent to about 30 weight percent and in embodiments, from about 0.1 weight percent to about 10 weight percent, based on the total weight of the photoconductive insulating layer after drying. Charge transporter components, such as arylamine hole transporter molecules can be present in various effective amounts, such as in an amount of from about 5 weight percent to about 50 weight percent and in embodiments, in an amount of from about 20 weight percent to about 40 weight percent. The electron transporter component can be present in various amounts, such as in an amount of from about 1 weight percent to about 40 weight percent and in embodiments, from about 5 weight percent to about 30 weight percent, based on the total combined weight of the hole transport molecules and the electron transport molecules. In embodiments, the combined weight of the arylamine hole transport molecules and the electron transport components in the photogenerating layer is from about 35 percent to about 65 percent by weight, based on the total weight of the photogenerating layer after drying. The GF-300 surfactant can be presented in an amount of 0.001 weight percent to about 2 weight percent. The film forming polymer binder can be present in an amount of from about 10 weight percent to about 75 weight percent and in embodiments from about 30 weight percent to about 60 weight percent, based on the total weight of the photogenerating layer after drying. The hole transport and electron transport molecules are dissolved, or molecularly dispersed in the film forming binder. The expression "molecularly dispersed", as employed herein is defined as dispersed on a molecular scale.

The above materials can be processed into a dispersion useful for coating by any of the conventional methods used to prepare such materials. These methods include ball milling, media milling in both vertical or horizontal bead mills, paint shaking the materials with suitable grinding media, and the like, to achieve a suitable dispersion. The photoconductive insulating layer may be prepared by any suitable method such as, for example, from a dispersion.

Since the photoresponsive imaging members of the present invention can be prepared by a number of known coating methods, the coating process parameters are dependent on the specific process, materials, coating component proportions, the final coating thickness desired, and the like. Drying may be carried out by any suitable technique. Typically, drying is carried out a temperature of from about 40 degrees centigrade to about 200 degrees centigrade for a suitable period of time. Typical drying times include, for example, from about 5 minutes to about 10 hours under still or flowing air conditions.

The imaging member may by employed in any suitable process such as, for example, copying, duplicating, printing, faxing, and the like. Typically, an imaging process may comprise forming a uniform charge on the imaging member of the present invention, exposing the imaging member to activating radiation in image configuration to form an electrostatic latent image, developing the latent image with electrostatically attractable marking material to form a marking material image, and transferring the marking material image to a suitable substrate. If desired, the transferred marking material image may be fixed to the substrate or transferred to a second substrate. Electrostatically attractable marking materials are well known and comprise, for example, thermoplastic resin, colorant, such as pigment, charge additive, and surface additives. Typical marking materials are disclosed in U.S. Pat. Nos. 4,560,635; 4,298,697 and 4,338,390, the entire disclosures thereof being incorporated herein by reference. Activating radiation may be from any suitable device such as an incandescent light, image bar, laser, and the like. The polarity of the electrostatic latent image on the imaging member of the present invention may be positive or negative. The hydroxygallium, x-polymorph metal free phthalocyanine, and chlorogallium phthalocyanine photogenerating pigments primarily function to absorb the incident radiation and generate electrons and holes. In a negatively charged imaging member, holes are transported to the imaging surface to neutralize negative charge and electrons are transported to the substrate to permit photodischarge. In a positively charged imaging member, electrons are transported to the imaging surface where they neutralize the positive charges and holes are transported to the substrate to enable photodischarge. By selecting the appropriate amounts of hole and electron transport molecules, ambipolar transport can be achieved, that is, the imaging member can be uniformly charged negatively or positively and the member can thereafter be photodischarged.

EXAMPLE I

Poly(phenylsilsesquioxane) can be prepared with 100 grams phenyltrichlorosilane, diluted with 120 milliliters of toluene and adding dropwise into 200 grams of ice water with stirring. The two-phase solution is then stirred at room temperature for 2 hours. The aqueous layer is removed, and the toluene layer is heated to refluxing for 4 hours under argon gas flow. The solution is cooled to room temperature and filtered to remove the non-soluble parts. The filtrate is poured into 300 milliliters of methanol with vigorous stirring. The white precipitate is then collected by filtration. The prepolymer is heated to 325 degrees Celsius for 30 minutes. The final product, a white powder is purified with toluene and methanol.

EXAMPLE II

Layered photoreceptor devices were made by hand coating charge transport layers on plant coated charge generation layers of hydroxygallium phthalocyanine (OHGaPc) in poly (4,4'-diphenyl-1,1'-cyclohexane carbonate)-400, with a weight average molecular weight of 40,000. A charge transport layer solution containing 45 weight percent poly(4,4'-diphenyl-1,1'-cyclohexane carbonate)-400, with a weight average molecular weight of 40,000, 5 weight percent poly(phenylsilsesquioxane), (PPSQ) and 50 weight percent N,N'-diphenyl-N,N'-bis(3-methylphenyl)-(1,1'-biphenyl)-4,4'diamine dissolved in a tetrahydrofuran/toluene mixture was prepared by adding 1.8 grams of poly(4,4'-diphenyl-1,1'-cyclohexane carbonate)-400, with a weight average molecular weight of 40,000 with 0.2 grams of poly(phenylsilsesquioxane) (PPSQ), 2.0 grams of charge transport molecule N,N'-diphenyl-N,N'-bis(3-methylphenyl)-(1,1'-biphenyl)-4,4'diamine and 23.0 grams of solvent methylene chloride at room temperature in a brown bottle. The brown bottle is placed on a rolling mill for 24 hours, resulting in a clear solution. This clear solution was ready for coating. The charge transport layer solution was hand coated, using a 6-mil gap bar, over a photoreceptor substrate with up-to charge generation layer. The device was oven dried at 100 degrees Celsius for 30 minutes. When scanned in a drum scanner, the charge transport was good, the residual voltage was less than 10 volts, and there was no cycle up in 10 k cycles. The photo-induced discharge curve, (PIDC) of this invented device and a device without poly(phenylsilsesquioxane), are shown in FIG. 1. The new device with poly (phenylsilsesquioxane) had very good electrical properties.

The prepared devices were electrically tested with a cyclic scanner set to obtain 100 charge-erase cycles immediately followed by an additional 100 cycles, sequences at 2 charge-erase cycles, and 1 charge-expose-erase cycle, wherein the light intensity was incrementally increased with cycling to produce a photoinduced discharge curve from which the photosensitivity was measured. The scanner was equipped with a scorotron set to a constant voltage charging at various surface potentials. The devices were tested at surface potentials of 350, 500, 650, and 800 volts with the exposure light intensity incrementally increased by means of regulating a series of neutral density filters, and the exposure light source was a 780 nanometer light emitting diode. The drum was rotated at a speed of 61 revolutions per minute to produce a surface speed of 25 inches per second or a cycle time of 0.984 per second. The entire xerographic simulation was carried out in an environmentally controlled light tight chamber at ambient conditions. Forty percent relative humidity and 22 degrees Celsius. Two photoinduced discharge characteristics (PIDC) curves were obtained and the data were interpolated to a PIDC curve at an initial surface potential of 800 volts, as shown in FIG. 1. Such method provides a valid comparison of electrophotographic properties for a device with poly(phenylsilsesquioxane) in the charge transport layer and a control device without poly (phenylsilsesquioxane) in the charge transport layer.

Although the invention has been described with reference to specific preferred embodiments, it is not intended to be limited thereto, rather those having ordinary skill in the art will recognize that variations and modifications including equivalents, substantial equivalents, similar equivalents, and the like may be made therein which are within the spirit of the invention and within the scope of the claims.

What is claimed is:

1. An imaging member comprising:

a conductive supporting substrate, charge blocking layer, a charge generating layer, a charge transport layer wherein the charge transport layer comprises a poly(phenylsilsesquioxane) homopolymer of the formula,

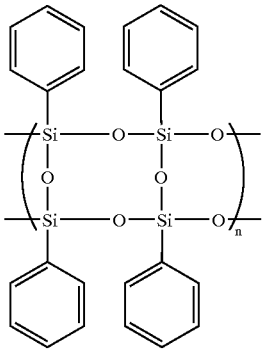

a film forming binder, and wherein n represents the number of repeating segments.

2. An imaging member according to claim 1, wherein the charge transport layer includes a solvent system.

3. An imaging member according to claim 2, wherein the solvent system is selected from the group consisting of tetrahydrofuran, toluene, and methylene chloride.

4. An imaging member according to claim 1, wherein the charge transport layer comprises N,N'-diphenyl-N,N'-bis-(3-methylphenyl)-(1,1'-biphenyl)-4,4'-diamine.

5. An imaging member according to claim 1, wherein the charge transport layer comprises said film forming binder in an amount of from about 25 to about 75 percent by weight, wherein a charge transporting aromatic amine compound is soluble in said film forming binder.

6. An imaging member according to claim 1, wherein the charge transport layer is comprised of an aryl amine of the formula:

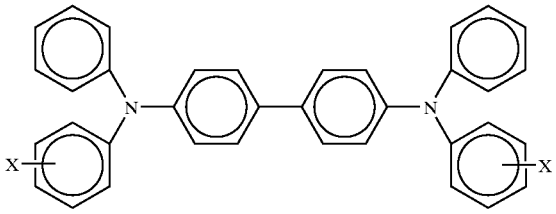

and wherein X is selected from the group consisting of alkyl and halogen.

7. An imaging member according to claim 1, wherein the charge transport layer comprises at least one member selected from the group consisting of N,N'-diphenyl-N,N'-bis(3-methylphenyl)-(1,1'-biphenyl)-4,4'-diamine; N,N'-diphenyl-N,N'-bis(alkylphenyl)-1,1-biphenyl-4,4'-diamine; tritolylamine; N,N'-bis-(3,4-dimethylphenyl)-4-biphenyl amine; N,N'-bis-(4-methylphenyl)-N,N' -bis(4-ethylphenyl)-1,1'-3,3'-dimethylbiphenyl)-4,4'-diamine; phenanthrene diamine; and stilbene molecules.

8. An imaging member according to claim 1, wherein the charge transport layer comprises an electron transport component selected from the group consisting of, 1,1'-dioxo-2-(4-methylphenyl)-6-phenyl-4-(dicyanomethylidene) thiopyran, butoxy carbonyl fluorenylidene malononitrile, carboxybenzylnaphthaquinone, tetra (t-butyl) diphenoquinone, perinone, thiopyran, N,N'-bis(1,2-dimethylpropyl)-1,4,5,8-naphthalenetetracarboxylic diimide, 1,1'-dioxo- 2-(4-methylphenyl)-6-(4-methylphenyl)-4-(dicyanomethylidene)thiopyran represented by:

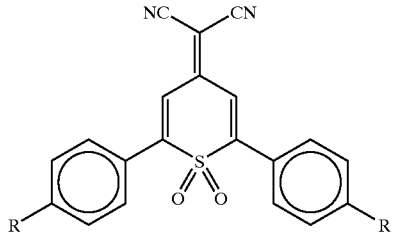

wherein each R is methyl and a quinone selected from the group consisting of:

carboxybenzylnaphthaquinone represented by:

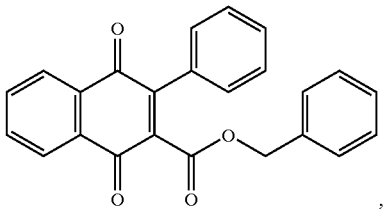

, and tetra (t-butyl) diphenoquinone represented by:

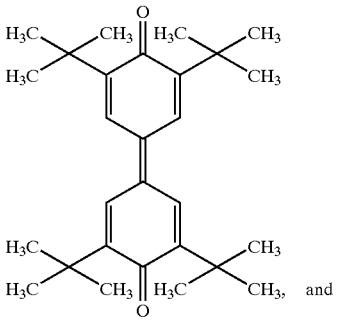

, and mixtures thereof.

9. An imaging member according to claim 8, wherein said electron transport component is N,N'-bis(1,2-dimethylpropyl)-1,4,5,8-naphthalenetetracarboxylic diimide.

10. An imaging member according to claim 1, wherein the binder is selected from the group consisting of polyesters, polyvinyl butyrals, polycarbonates, polystyrene-b-polyvinyl pyridine, poly(vinyl butyral), poly(vinyl carbazole), poly (vinyl chloride), polyacrylates, polymethacrylates, copolymers of vinyl chloride and vinyl acetate, phenoxy resins, polyurethanes, poly(vinyl alcohol), polyacrylonitrile, and polystyrene.

11. An imaging member according to claim 10, wherein the binder is a polycarbonate in an amount of 45 percent by weight of the total weight of the charge transport layer.

12. An imaging member according to claim 11, wherein the polycarbonate is poly(4,4'-diphenyl-1,1'-cyclohexane) carbonate.

13. The image member according to claim 1, wherein the supporting substrate is in the form of a drum.

14. An imaging process comprising providing an imaging member comprising a conductive supporting layer and a photogenerating layer, a charge transport layer, the charge transport layer comprising poly(phenylsilsesquioxane) homopolymer, depositing a uniform electrostatic charge on the imaging member, exposing the imaging member to activating radiation in image configuration to form an electrostatic latent image, and developing the electrostatic latent image with electrostatically attractable marking particles to form an image in conformance to the electrostatic latent image.

15. The imaging process according to claim 14, wherein the photogenerating layer has a thickness of from about 0.1 micrometers to about 5.0 micrometers.

* * * * *